US012504261B2

(12) United States Patent
Koehler et al.

(10) Patent No.: US 12,504,261 B2
(45) Date of Patent: Dec. 23, 2025

(54) EXPLOSIVE FRAGMENTATION STRUCTURE WITH A FRAGMENT ENHANCING INSENSITIVE MUNITIONS (IM) LINER

(71) Applicant: Raytheon Company, Arlington, VA (US)

(72) Inventors: Frederick B. Koehler, Tucson, AZ (US); John R. Leach, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/583,697

(22) Filed: Feb. 21, 2024

(65) Prior Publication Data

US 2025/0264313 A1 Aug. 21, 2025

(51) Int. Cl.
*F42B 12/20* (2006.01)
*F42B 12/22* (2006.01)

(52) U.S. Cl.
CPC ..... *F42B 12/207* (2013.01); *F42B 12/22* (2013.01)

(58) Field of Classification Search
CPC ..... F42B 12/207; F42B 12/22
USPC ..... 102/491
See application file for complete search history.

(56) References Cited

U.S. PATENT DOCUMENTS 1,303,727 A * 5/1919 Rice ..... F42B 12/24 102/493
3,447,463 A 6/1969 Lavine
3,491,694 A * 1/1970 Fountain ..... F42B 12/22 102/493
3,566,794 A * 3/1971 Pearson ..... F42B 12/22 102/493
3,799,054 A * 3/1974 LaRocca ..... F42B 12/22 102/491
4,745,864 A * 5/1988 Craddock ..... F42B 12/22 102/493
5,337,673 A * 8/1994 Koontz ..... F42B 12/22 102/493
7,886,667 B1 * 2/2011 Baker ..... F42B 12/22 102/493
8,272,329 B1 * 9/2012 Hsieh ..... F42B 12/24 102/494
8,627,771 B1 * 1/2014 Gold ..... F42B 12/22 102/494
10,982,942 B1 * 4/2021 Stowe ..... F42D 5/045

FOREIGN PATENT DOCUMENTS

FR 2993355 A1 * 1/2014 ..... F42B 12/207
WO WO-2015102001 A1 * 7/2015 ..... B64C 39/024
WO WO-2024054142 A1 * 3/2024

* cited by examiner

*Primary Examiner* — Samir Abdosh
(74) *Attorney, Agent, or Firm* — Schwegman Lundberg & Woessner, P.A.

(57) ABSTRACT

An explosive fragmentation structure includes a fragment enhancing insensitive munitions (IM) liner. The IM liner includes a patterned metal structure having openings therethrough embedded in a compressible material to define a desired fragmentation pattern of the outer metal casing upon detonation of the explosive. The IM layer is positioned between and in conformal contact with the outer metal casing's inner surface and the explosive's outer surface.

22 Claims, 5 Drawing Sheets

EXPLOSIVE FRAGMENTATION STRUCTURE WITH A FRAGMENT ENHANCING INSENSITIVE MUNITIONS (IM) LINER

BACKGROUND

Field

This disclosure relates to explosive fragmentation structures such as warheads, mines, etc., and, more particularly, to structures and techniques for selectively controlling the size and shape of the fragments produced without compromising safety or long-term stability.

Description of the Related Art

As described in U.S. Pat. No. 4,745,864 entitled "Explosive Fragmentation Structure" fragmentation structures, such as fragmentation warheads, mines, etc., are employed by the military against a wide variety of targets where dispersion of fragments over a target area is required. A problem which arises in their use is that fragmentation warheads suitable for use against personnel are generally not suitable for use against "hard" targets such as armored vehicles and emplacements, where fragments of relatively greater size and mass are required. Military units have therefore been required to maintain supplies of several types of fragmentation warheads, each type adapted for use against a particular type of target. This results in an increased burden of logistics and supply and is, of course, highly undesirable. In the past, it has been attempted to minimize this problem by constructing warheads having two sections, one section being adapted to disperse fragments of one size and the other being adapted to disperse fragments of another size. In this manner, a single warhead may be utilized against a variety of targets. Such a construction, however, is inefficient in that, in each case, portions of the warhead not designed for the particular application are largely ineffective; furthermore, in order to produce a given amount of destructive force, a warhead of larger dimensions is necessary than would be the case for one designed for the specific application.

Other problems related to the construction of fragmentation warheads have involved the expense of machining or casting a multiplicity of grooves or openings in the metal casings to induce fragmentation of the casing in a desired pattern by establishing preferential fracture lines. Alternatively, an inner casing having openings or grooves formed therethrough is disposed within an outer metal casing and configured such that it directs explosive shock waves from an internal explosive charge against the outer casing in a grid-like pattern, such that the outer casing is fractured along the grid lines. In all cases, the molding, machining, or forging of metal structures into a desired, grid-like pattern is undesirably expensive, particularly when large quantities of weapons are to be manufactured. A further, related problem present with any explosive device is the danger of accidental detonation of the explosive charge by either mechanical shock or heat. Under combat conditions, for example, stored ammunition may be jarred by incoming rounds or careless handling, or it may be heated by fires started by incoming rounds. In any case, it is desirable that the ammunition be as resistant as possible to such heat and shock.

The U.S. Pat. No. 4,745,864 patent specifically discloses an explosive, fragmentation structure having means for selectively controlling fragment size and configuration. The structure includes an outer casing having an inner surface defining a chamber and further includes means for propagating shock waves across the inner surface from a selected one of two detonation points with the chamber. Means are provided for directing shock waves, propagated from the first detonation point, against the surface in a first pattern of segment-defining lines and for directing shock waves, propagated from the second detonation point, against the surface in a second pattern of lines which define segments larger than those of the first pattern. The means for directing the shock waves comprise grooves/slots formed in a layer of compressible material (e.g., the insensitive munitions (IM) liner) lining at least a selected portion of the inner surface of the outer casing and opening at least toward the outer casing, at least some of the grooves/slots, in cross section, being inclined, with respect to the adjacent inner surface of the casing, toward the first detonation point for passing detonation shock waves, propagated from the first detonation point, to the outer casing, and wherein the second directing means comprises grooves/slots formed in the layer of material and opening at least toward the outer casing, at least some of the grooves of the second directing means being inclined, in cross section and with respect to the adjacent inner surface of the casing, toward the second detonation point for passing detonation shock waves, propagated from the second detonation point, to the outer casing.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a fragment enhancing insensitive munitions (IM) liner for an explosive fragmentation structure. The fragment enhancing IM liner provides fragmentation performance that approximates scoring or otherwise manipulating the outer metal casing, at reduced costs without degrading the safety and long term stability provided by the IM liner or taking up any volume that could otherwise be used for explosive.

This is accomplished by embedding a patterned metal structure having openings formed therethrough within the IM liner and placing the IM liner between and in conformal contact with the outer metal casing and explosive.

In an embodiment, an explosive fragmentation structure includes an outer metal casing having an inner surface defining a chamber and an explosive positioned inside the chamber. The explosive has an outer surface with a complementary shape to the inner surface of the outer metal casing. An IM liner is positioned between and in conformal contact with the outer metal casing's inner surface and the explosive's outer surface to minimize air gaps. The IM liner includes a patterned metal structure having openings formed therethrough embedded in a compressible material defining a desired fragmentation pattern of the outer metal casing upon detonation of the explosive.

In an embodiment, the compressible material such as plastics, thermoplastics or thermoset polymers has a modulus of elasticity between 600-1500 MPA and a melting point between 60-150° C. The patterned metal structure is suitably formed from one of steel, beryllium or a refractory alloy chosen to facilitate patterned shock wave propagation. The metal will have a shock wave propagation at least twice that of the compressible material. By comparison, steel has a modulus of elasticity of 200 GPA and a melting point of over 1200° C.

In different embodiments the explosive fragmentation structure is a missile warhead, artillery shell, mine or torpedo.

In different embodiments, multiple patterned metal structures may be embedded in the compressible material.

In an embodiment, the patterned metal structure may be placed in an uncured compressible material at a desired level and the material cured to form the IM liner. The patterned metal structure may be placed in the middle of the compressible material equidistant to the outer metal casing and the explosive or biased towards either side. Additional patterned metal structures may be positioned at different levels.

In an embodiment, the openings in the patterned metal structure are filled with uncured compressible material and cured to form the IM liner in which the patterned metal structure is exposed at both the top and bottom surfaces of the IM liner to directly contact the outer metal casing's inner surface and the explosive's outer surface.

In an embodiment, a layer of compressible material such as a standard IM liner is patterned to form at least one recessed pattern in the top or bottom surfaces of the layer. Metal is formed in the at least one recessed pattern to form the patterned metal structure.

These and other features and advantages of the disclosure will be apparent to those skilled in the art from the following detailed description of preferred embodiments, taken together with the accompanying drawings, in which:

DETAILED DESCRIPTION

An explosive fragmentation structure such as an artillery shell, missile warhead, mine, torpedo or the like includes an outer metal casing having an inner surface defining a chamber and an explosive positioned inside the chamber. The explosive has an outer surface with a complementary shape to the inner surface of the outer metal casing. Upon detonation of the explosive, a shock wave propagates outwards causing the outer metal casing to fragment and propel the fragments outwards.

In many such structures, an IM liner is positioned between and in conformal contact with the outer metal casing's inner surface and the explosive's outer surface to minimize air gaps, which can heat up and initiate detonation in high-G environments. The IM liner is formed from a compressible material such as plastics, thermoplastics or thermoset polymers has a modulus of elasticity between 600-1500 MPA and a melting point between 60-150° C. The function of the liner is to soften of even melt when heated to give the explosive volume in which to expand. This alleviates pressure on the explosive, which may prevent an incidental detonation in favor of a less violent reaction.

The present disclosure provides a fragment enhancing insensitive munitions (IM) liner for an explosive fragmentation structure. The fragment enhancing IM liner provides fragmentation performance that approximates scoring or otherwise manipulating the outer metal casing, at reduced costs without degrading the safety and long-term stability provided by the IM liner or taking up any volume that could otherwise be used for explosive.

This is accomplished by embedding a patterned metal structure having openings formed therethrough within the IM liner and placing the IM liner between and in conformal contact with the outer metal casing and explosive. The patterned metal structure may, for example, take up only 5% of the volume of the IM liner. Metals provide faster shock wave propagation than the compressible material (at least 2×) to either shape the shock wave that is directly transmitted to the outer metal casing or to constructively or destructively interfere the shock wave to impact the outer metal casing and initiate fracture of outer metal casing to expel fragments of the desired shape and pattern. Metals may, for example, include steel, beryllium or refractory metals such as tungsten that exhibit the proper density or crystal structure to facilitate shock wave propagation. Steel, for example, has an elastic modulus of 200 KPA and a melting point over 1200° C.

Figure 1A:
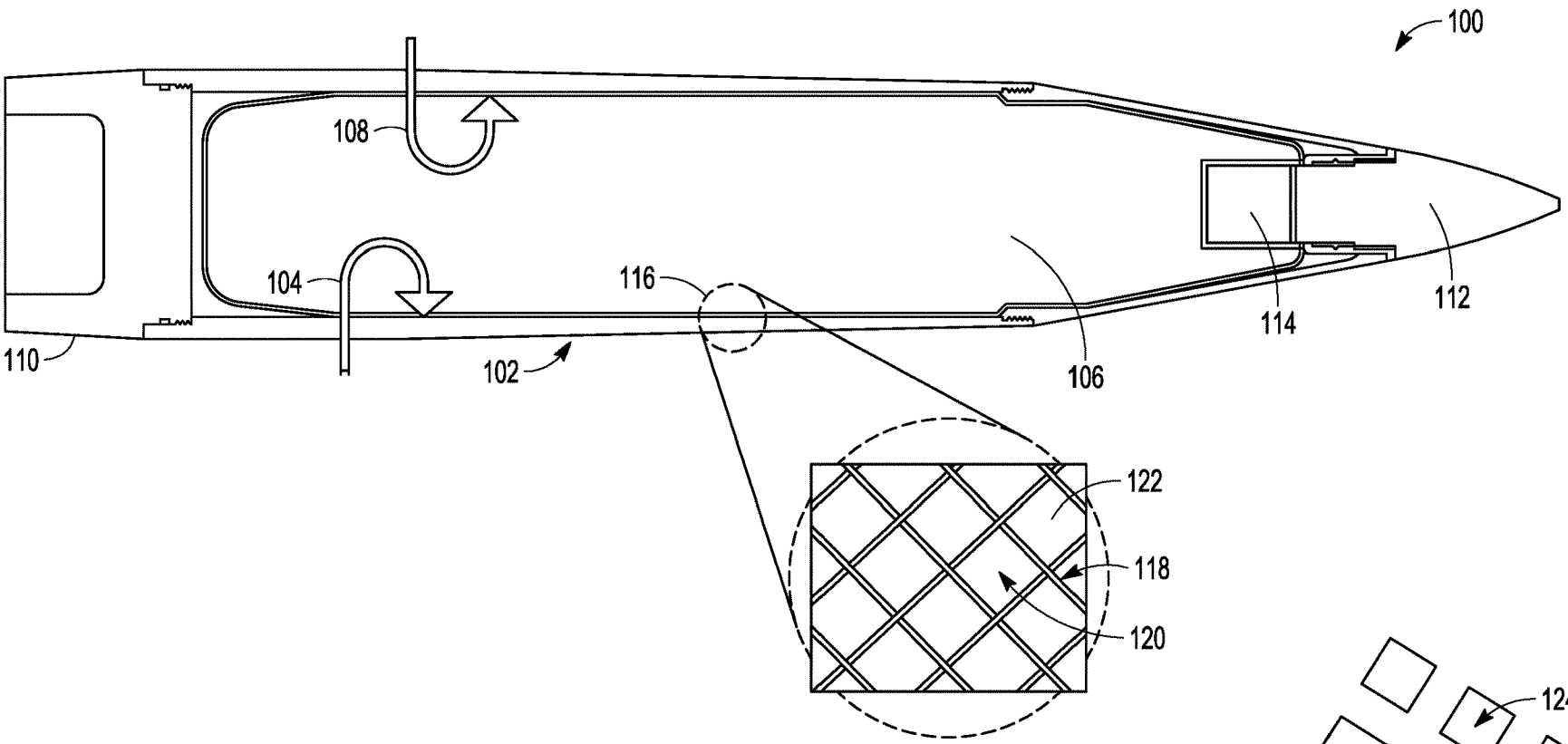
FIGS. 1A-1B are views of an explosive fragmentation structure with a fragment enhancing insensitive munitions (IM) liner and the fragmentation pattern produced upon detonation of the explosive.
Figure 1B:
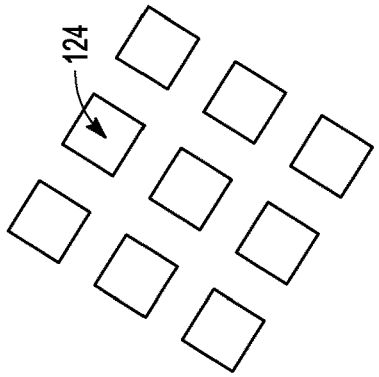

With reference to FIGS. 1A-1B, an embodiment of an artillery shell 100 includes an outer metal casing 102 having an inner surface 104 defining a chamber and an explosive 106 positioned inside the chamber. The explosive has an outer surface 108 with a complementary shape to the inner surface 104 of the outer metal casing 102. Artillery shell 100 includes a base 110 (to facilitate firing) aft of the outer metal casing 102 and a fuze 112 and detonation booster 114 forward of outer metal casing 102. An IM liner 116 is positioned between and in conformal contact with the outer metal casing's inner surface 104 and the explosive's outer surface 108 to minimize air gaps. IM liner 116 includes a patterned metal structure 118 having openings 120 formed therethrough embedded within a compressible material 122. Openings 120 are filled with compressible material 122. Upon detonation of the explosive, a shock wave propagates outwards through the IM liner 116 where it travels faster through the patterned metal structure 118 than the compressible material 122 such that the shock wave fractures the outer metal casing 102 along lines corresponding to the patterned metal structure 118 causing the outer metal casing to fragment and expel fragments 124 outwards with the desired shape (e.g., squares) and pattern.

Figure 2A:
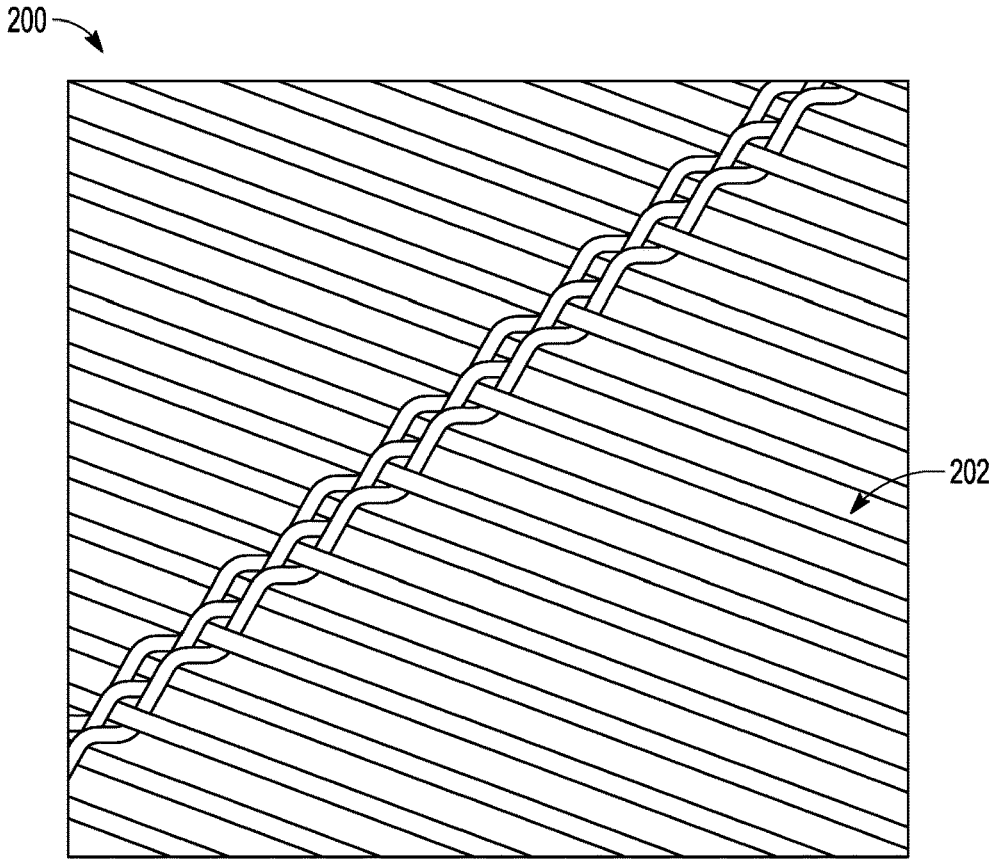
FIGS. 2A-2B are views of the patterned metal structure for different fragment shapes.
Figure 2B:
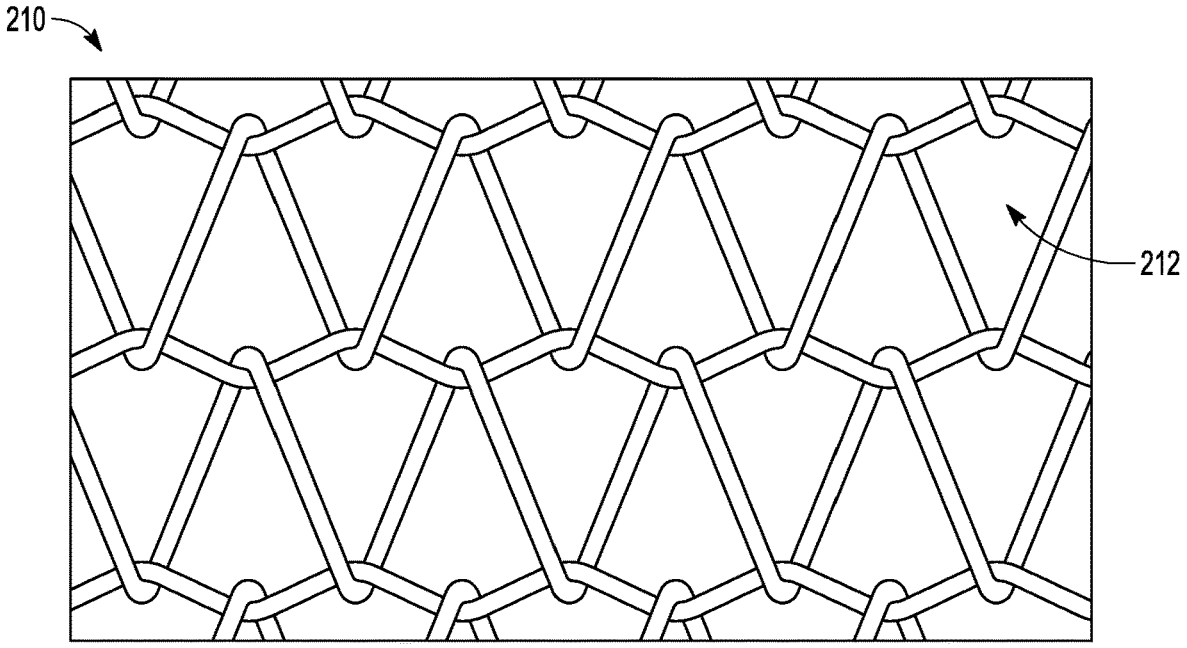

Referring now to FIGS. 2A-2B, an embodiment of a patterned metal structure 200 is formed with rectangularly shaped openings 202 to produce rectangularly shaped fragments and an embodiment of a patterned metal structure 210 is formed with triangular shaped openings 212 to produce triangularly shaped fragments. In general, the openings can be formed with any shape and size to produce fragments with a desired shape and size depending upon the application. Furthermore, a given patterned metal structure may include a single shape but in different sizes at different locations along the outer metal casing or may include different shapes along the outer metal casing.

Figure 3:
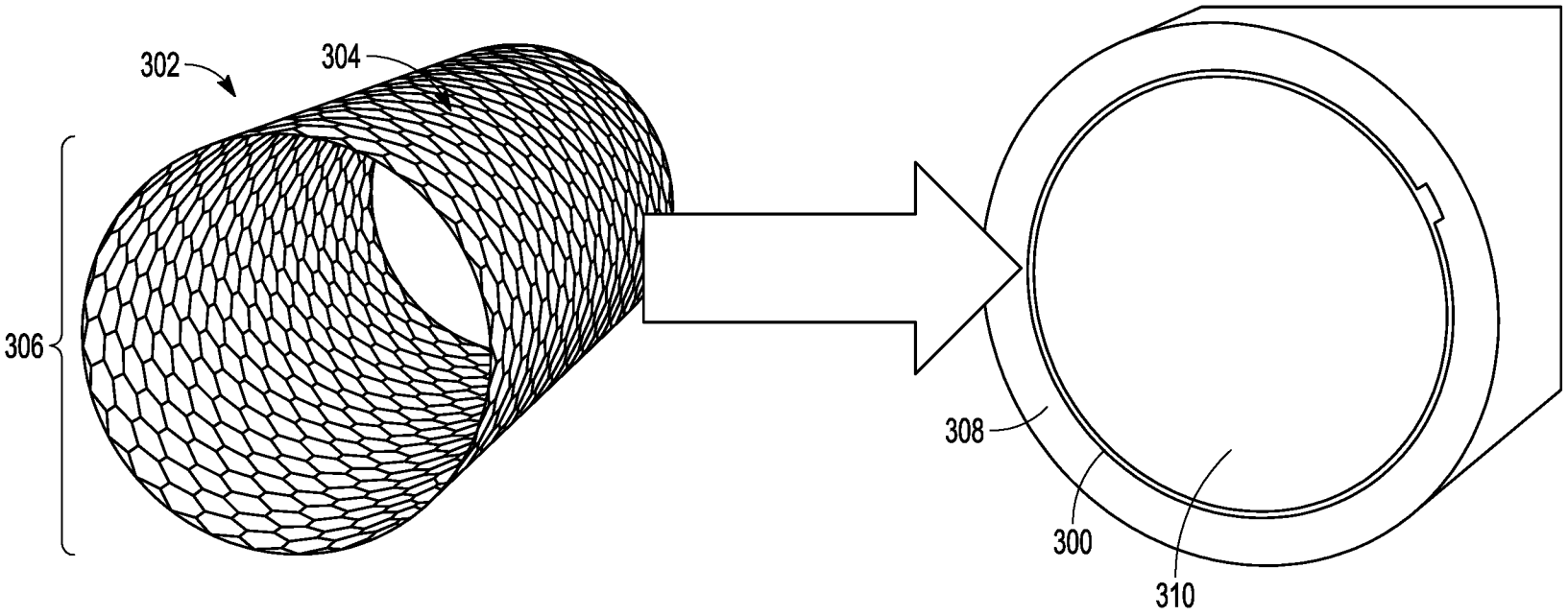
FIG. 3 is a view of a IM liner including a patterned metal structure embedded in a compressible material formed as a sleeve positioned between the outer metal casing and the explosive.

Referring now to FIG. 3, an IM liner 300 includes a patterned metal structure 302 having hexagonal openings 304 formed therethrough embedded in a compressible material. The IM liner 300 is formed into a sleeve 306 that is positioned between and in conformal contact with a cylindrical outer metal casing 308 and a cylindrical explosive 310.

The fragment enhancing insensitive munitions (IM) liner maybe fabricated and assembled with the explosive fragmentation structure in a number of ways. In general, this includes embedding a patterned metal structure having openings formed therethrough in a compressible material to form an insensitive munitions (IM) liner and positioning the IM liner between and in conformal contact with an outer metal casing's inner surface and an explosive's outer surface.

Figure 4A:
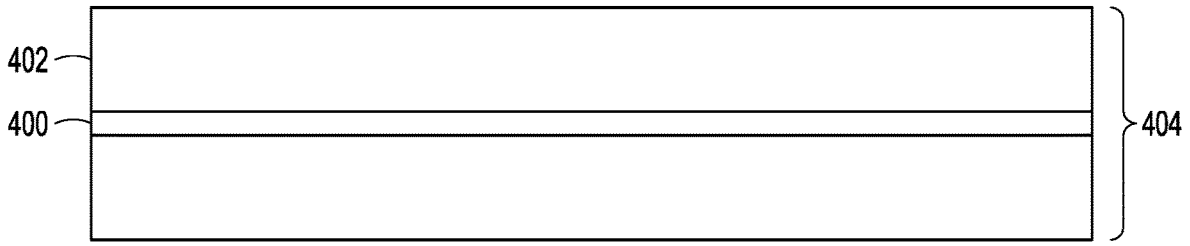
FIGS. 4A-4B are side views of embodiments of an IM liner in which one or two thin patterned metal structure are embedded within the compressible material.
Figure 4B:
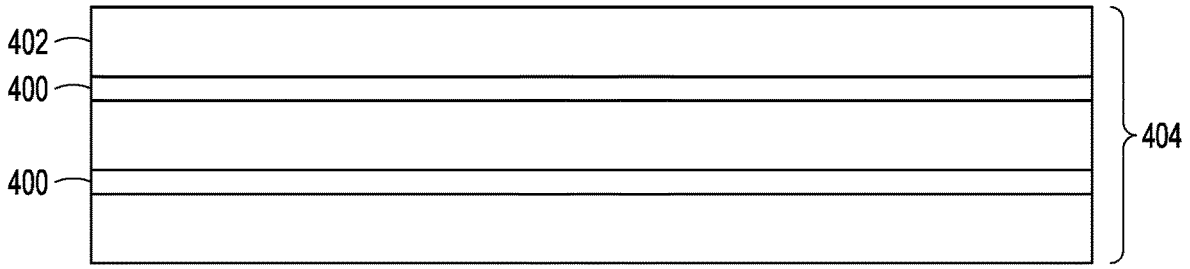

Referring now to FIGS. 4A and 4B, in an embodiment, one or more patterned metal structures 400 are placed in an uncured compressible material 402, which is then cured the to form the IM liner 404. With a single patterned metal structure 400, the structure may be positioned in the middle of the compressible material equal distance from the outer metal casing and the explosive. Alternately, the structure may be positioned in the compressible material closer to the outer metal casing than the explosive but away from the outer metal casing's inner surface. Alternately, the structure may be positioned in the compressible material closer to the explosive than the outer metal casing but away from the outer explosive's outer surface. Alternately, the structure may be positioned at either the top or bottom surfaces of the compressible material. With a plurality of patterned metal structures 400, the structures can be placed at top and bottom surfaces of the compressible material or at different levels therein.

Figure 5:
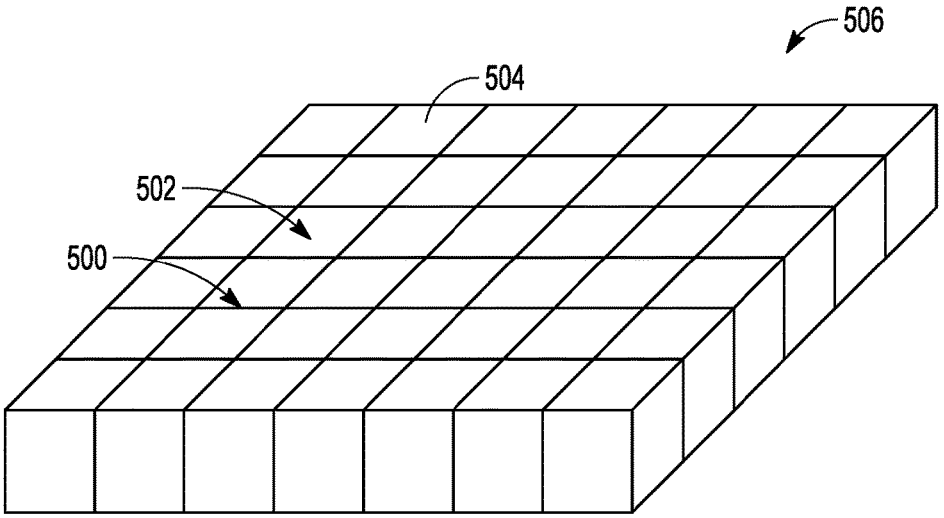
FIG. 5 is a perspective view of an embodiment of an IM liner in which a thick patterned metal structure is embedded within and extends to the opposing surfaces of the compressible material.

Referring now to FIG. 5, in an embodiment, a thick patterned metal structure 500 is provided having a thickness equal to that of the IM liner. Openings 502 in patterned metal structure 500 are filled with uncured compressible material 504 and cured to form IM liner 506 in which the patterned metal structure is exposed at both outer and inner surfaces of the IM liner to directly contact the outer metal casing's inner surface and the explosive's outer surface.

Figure 6A:
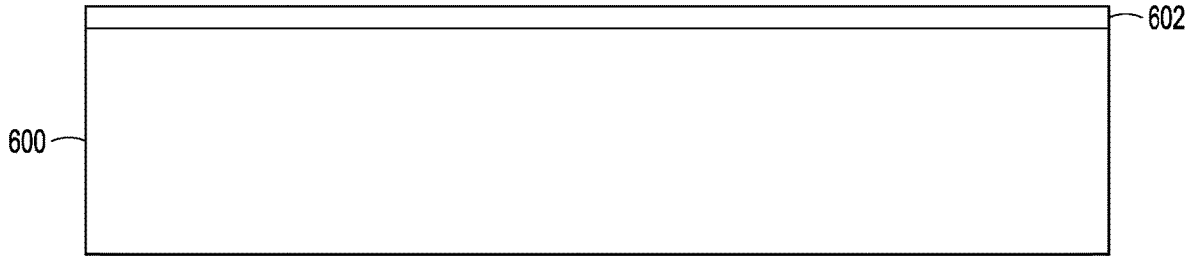
FIGS. 6A-6B are side views of embodiments of an IM liner in which a layer of compressible material is patterned and filled with metal material to embed the patterned metal structure on either or both sides of the compressible material.
Figure 6B:
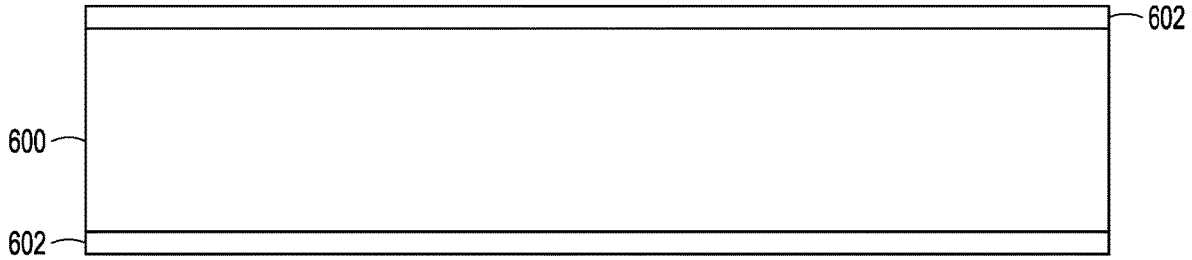

Referring now to FIGS. 6A-6B, in an embodiment, a layer 600 of compressible material (e.g., a standard IM liner) is provided. One or more of the top or bottom surfaces of the layer 600 are patterned to form one or more recessed patterns in the IM liner. Metal is formed in the one or more recessed patterns to form the patterned metal structure 602 embedded in at least one of the top or bottom surface of the layer of compressible material. The metallization may be accomplished with an epoxy or metal powder-based substance that fills the recessed pattern(s) and dries to form the structure.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. An explosive fragmentation structure, comprising:

an outer metal casing having an inner surface defining a chamber;

an explosive positioned inside the chamber, said explosive having an outer surface with a complementary shape to the inner surface of the outer metal casing; and an insensitive munitions (IM) liner positioned between and in conformal contact with the outer metal casing's inner surface and the explosive's outer surface, said IM liner including a patterned metal structure having openings formed therethrough embedded in a compressible material such that the IM liner is devoid of any air gaps, said IM liner defining a desired fragmentation pattern of the outer metal casing upon detonation of the explosive.

2. The explosive fragmentation structure of claim 1, wherein the compressible material has a modulus of elasticity between 600-1500 MPA and a melting point between 60-150° C.

3. The explosive fragmentation structure of claim 1, wherein the patterned metal structure is formed from one of steel, beryllium or a refractory alloy.

4. The explosive fragmentation structure of claim 1, wherein the metal has a shock propagation at least twice the shock propagation of the compressible material.

5. The explosive fragmentation structure of claim 1, wherein there are no air gaps between the outer metal casing and the explosive.

6. The explosive fragmentation structure of claim 1, further comprising a second patterned metal structure having openings formed therethrough embedded in the compressible material.

7. The explosive fragmentation structure of claim 1, wherein the structure is one of a missile warhead, an artillery shell, a mine or a torpedo.

8. The explosive fragmentation structure of claim 1, wherein the patterned metal structure is positioned in the middle of the compressible material equal distance from the outer metal casing and the explosive.

9. The explosive fragmentation structure of claim 1, wherein the patterned metal structure is positioned in the compressible material closer to the outer metal casing than the explosive but away from the outer metal casing's inner surface.

10. The explosive fragmentation structure of claim 1, wherein the patterned metal structure is positioned in the compressible material closer to the explosive than the outer metal casing but away from the explosive's outer surface.

11. The explosive fragmentation structure of claim 1, wherein the patterned metal structure extends to outer and inner surfaces of the IM liner to directly contact both the outer metal casing's inner surface and the explosive's outer surface.

12. The explosive fragmentation structure of claim 1, wherein the patterned metal structure is embedded in a top surface of the compressible material and directly contacts the outer metal casing's inner surface.

13. The explosive fragmentation structure of claim 1, wherein the patterned metal structure is embedded in a bottom surface of the compressible material and directly contacts the explosive's outer surface.

14. The explosive fragmentation structure of claim 1, wherein the patterned metal structure is embedded in a top surface of the compressible material and directly contacts the outer metal casing's inner surface, further comprising a second patterned metal structure embedded in a bottom surface of the compressible material and directly contacts the explosive's outer surface.

15. A method of fragmentation enhancement in an explosive fragmentation structure, the method comprising:

embedding a patterned metal structure having openings formed therethrough in a compressible material to form an insensitive munitions (IM) liner that is devoid of any air gaps; and positioning the IM liner between and in conformal contact with an outer metal casing's inner surface and an explosive's outer surface.

16. The method of claim 15, wherein the embedding step comprises:

placing the patterned metal structure in an uncured compressible material; and curing the compressible material to form the IM liner.

17. The method of claim 15, wherein the embedding step comprises:

providing the patterned metal structure having a thickness equal to that of the IM liner;

filling the openings in the patterned metal structure with uncured compressible materials; and curing the compressible material to form the IM liner in which the patterned metal structure is exposed at both outer and inner surfaces of the IM liner to directly contact the outer metal casing's inner surface and the explosive's outer surface.

18. The method of claim 15, wherein the embedding step comprises:

providing a layer of compressible material;

patterning at least one of a top or bottom surface of the layer of compressible material to form at least one recessed pattern in the layer that exposes at least one indented surface in the top or bottom surface of the layer of compressible material;

forming metal on the indented surface in the at least one recessed pattern to form the patterned metal structure embedded in at least one of the top or bottom surface of the layer of compressible material.

19. The explosive fragmentation structure of claim 1, wherein the patterned metal structure is placed in an uncured compressible material and cured to form the IM liner.

20. The explosive fragmentation structure of claim 1, wherein the patterned metal structure has a thickness equal to that of the IM liner, wherein openings in the patterned metal structure are filled with uncured compressible materials and cured to form the IM liner in which the patterned metal structure is exposed at both outer and inner surfaces of the IM liner to directly contact the outer metal casing's inner surface and the explosive's outer surface.

21. The explosive fragmentation structure of claim 1, wherein a top or bottom surface of the layer of compressible material is patterned to form at least one recessed pattern in the layer, wherein said at least one recessed pattern exposes an indented surface in the top or bottom surface of the compressible material, wherein the patterned metal structure is formed on the indented surface in the at least one recessed pattern.

22. The explosive fragmentation structure of claim 1, wherein the compressible material fills the openings in the patterned metal structure and any volume above or below the patterned metal structure so that the IM liner is devoid of any air gaps.

* * * * *